US006190017B1

(12) United States Patent
Lai

(10) Patent No.: US 6,190,017 B1
(45) Date of Patent: Feb. 20, 2001

(54) SAFE ELECTRIC LUMINESCENCE NIGHT LAMP

(76) Inventor: Li-Chun Lai, 21F-1, No. 33, Sec. 1, Min Sheng Road, Panchiao City, Taipei Hsien (TW)

( * ) Notice: Under 35 U.S.C. 154(b), the term of this patent shall be extended for 0 days.

(21) Appl. No.: 09/265,517

(22) Filed: Mar. 10, 1999

(51) Int. Cl.[7] ..... F21V 33/00
(52) U.S. Cl. ..... 362/95; 362/84; 362/226
(58) Field of Search ..... 362/84, 95, 226

(56) References Cited

U.S. PATENT DOCUMENTS

| | | | | |
|---|---|---|---|---|
| 3,307,030 | * | 2/1967 | De Francisco | 362/95 |
| 4,000,405 | * | 12/1976 | Horwinski | 362/95 |
| 5,816,682 | * | 10/1998 | Marischen | 362/84 |
| 5,964,516 | * | 10/1999 | Lai | 362/95 |

* cited by examiner

*Primary Examiner*—Stephen Husar
(74) *Attorney, Agent, or Firm*—Pro-Techtor International Services

(57) ABSTRACT

An improved structure of electric luminescence night lamp comprises a main housing body, a electric luminescence piece and a top cover. The main housing body is provided with a receptacle at its front face for reception of the electric luminescence piece, and a plug on its back for connecting with power supply to lighten the electric luminescence piece. A rectangular opening formed at somewhere decent in the housing body is provided with lateral grooves and is sealed by a top cover with lateral tracks. The top cover is combined to the housing body by slipped the tracks into the grooves and is movable to open or close the rectangular opening, and moreover, the top cover is also provided with a plurality of anti-slip strips on its front face to prevent a finger from slipping when push it to move. In virtue of the top cover, a neighboring socket can be protected, or happening of unexpected dangers.

1 Claim, 2 Drawing Sheets

SAFE ELECTRIC LUMINESCENCE NIGHT LAMP

BACKGROUND OF THE INVENTION

1. Field of the Invention

This invention relates to a structure of safe electric luminescence night lamp, particularly to a night lamp that radiates safe electric luminescence with a given cover disposed at lower portion of the structure for protection power socket.

2. Description of the Prior Art

As a night lamp is usually used in a bedroom, a corridor, or a dim place for illumination and decoration at nighttime successively, so that it must always be plugged in a socket for keeping at decent lightness indoors. However, a tiny incandescent bulb or a bigger usual bulb is commonly used in a conventional night lamp to serve as a light source: the former is working with relatively larger power consumption and weaker illumination intensity that can function no more than a decoration article, while the latter may be found unstable with its center of gravity to result in loosening, detachinig, or poor electric connecting, etc.

Moreover, as mentioned above, a night lamp is constantly plugged in a socket, it would be better to cover and protect the neighboring socket, the present inventor of this invention has submitted a related precedent patent application Ser. No. 08/996,471 to U.S.A. authorities dated Nov. 7, 1997.

In view of the above-described imperfections, after years of constant effort in research, the present inventor of this invention finally manages to propose an improved mechanism pertaining to the subject matter.

SUMMARY OF THE INVENTION

This invention is proposed to provide an improved structure of electric luminescence night lamp that is offered with a electric luminescence piece in front face of main housing body of the night lamp to serve as a luminescence source providing decent illumination.

Another object of this invention is to provide an improved structure of electric luminescence night lamp, which is plugged in a socket panel flatly and intimately to fortify center of gravity of the night lamp in order not to get loosened or dropped.

A further object of this invention is to provide an improved structure of electric luminescence night lamp, which is provided with a top cover at a decent portion of the main housing body for covering and protecting the neighboring socket or electric shock incurred by unconscious touch.

The above said merits possessed electric luminescence night lamp of this invention comprises: a main housing body, a electric luminescence piece. and a top cover. The housing body is provided with a receptacle in its front face, and a rectangular opening at somewhere decent corresponding to a neighboring socket underneath the socket panel, wherein a pair of slide grooves is disposed on inner edge of the rectangular opening. The electric luminescence piece placed in the receptacle is serving for the light source of the night lamp. A pair of slide tracks is provided laterally at inner face of the top cover, which is to be slipped into the grooves to combine with the housing body, and moreover, the top cover is provided with a plurality of anti-slip strips on its surface to facilitate pushing the top cover to slip into the grooves.

BRIEF DESCRIPTION OF THE DRAWINGS

For a better understanding to the present invention, together with further advantages or features thereof, at least one preferred embodiment will be elucidated below with reference to the annexed drawings in which.

DESCRIPTION OF THE PREFERRED EMBODIMENT

Figure 1:
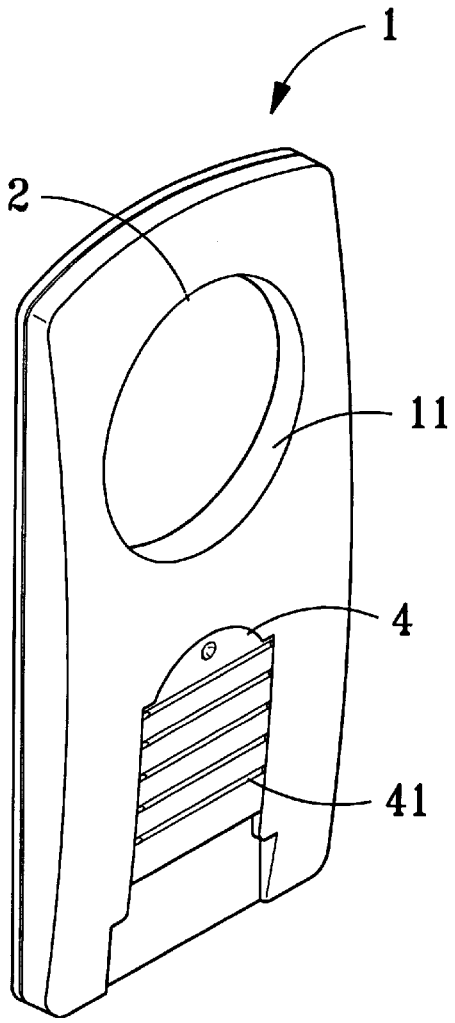
FIG. 1 is a three-dimensional view showing structure of an electric luminescence night lamp of this invention.
Figure 2:
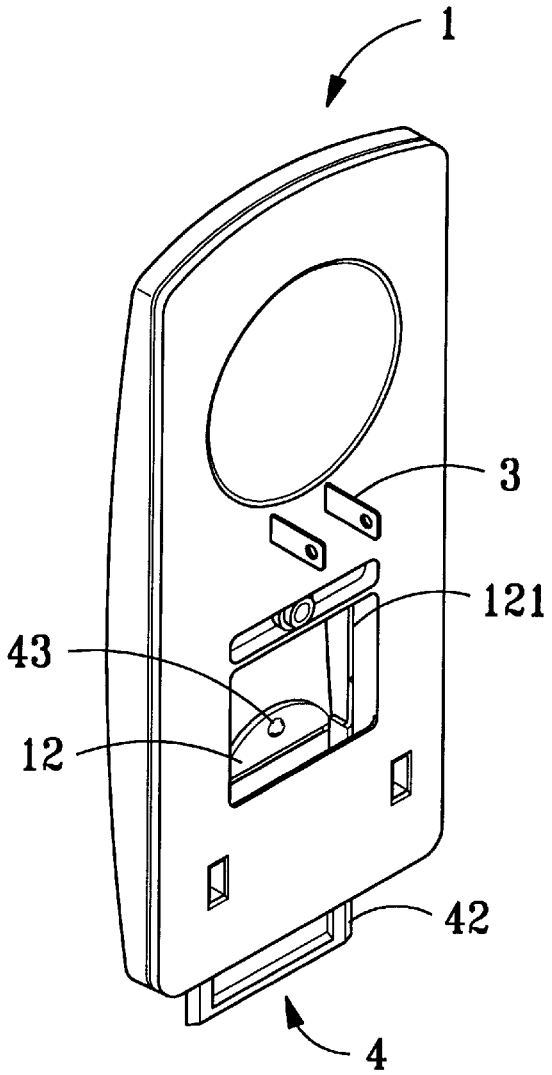
FIG. 2 is a three-dimensional rear view showing structure of an electric luminescence night lamp of this invention.

As shown in FIG. 1 and 2, an improved structure of an electric luminescence night lamp of this invention comprises a main housinig body 1, a electric luminescence piece 2 and a top cover 4. A receptacle 11 is disposed in front face of the housing body 1 for reception of the electric luminescence piece 2, and a plug 3 located on back of the housing body 1 is to connect power supply with the electric luminescence piece 2 for illumination. A rectangular opening 12 formed in somewhere decent in the housing body 1 is provided with the top cover 4, wherein a pair of slide tracks 42 disposed at two lateral edges on inner face of the top cover 4 is compatible to a pair of lateral slide grooves 121 on the rectangular opening 12. The top cover 4 combined with the housing body I by slipping the slide tracks 42 into the slide grooves 121 can slide back and forth on the housing body 1 to open or close the rectangular opening 12. A protrusion dot 43 formed on inner face of the top cover 4 at its top end is snapped and fastened to the housing body 1, and on outer surface of the top cover 4, a plurality of anti-slip strips 41 is formed to prevent from slipping when pushing.

Figure 3:
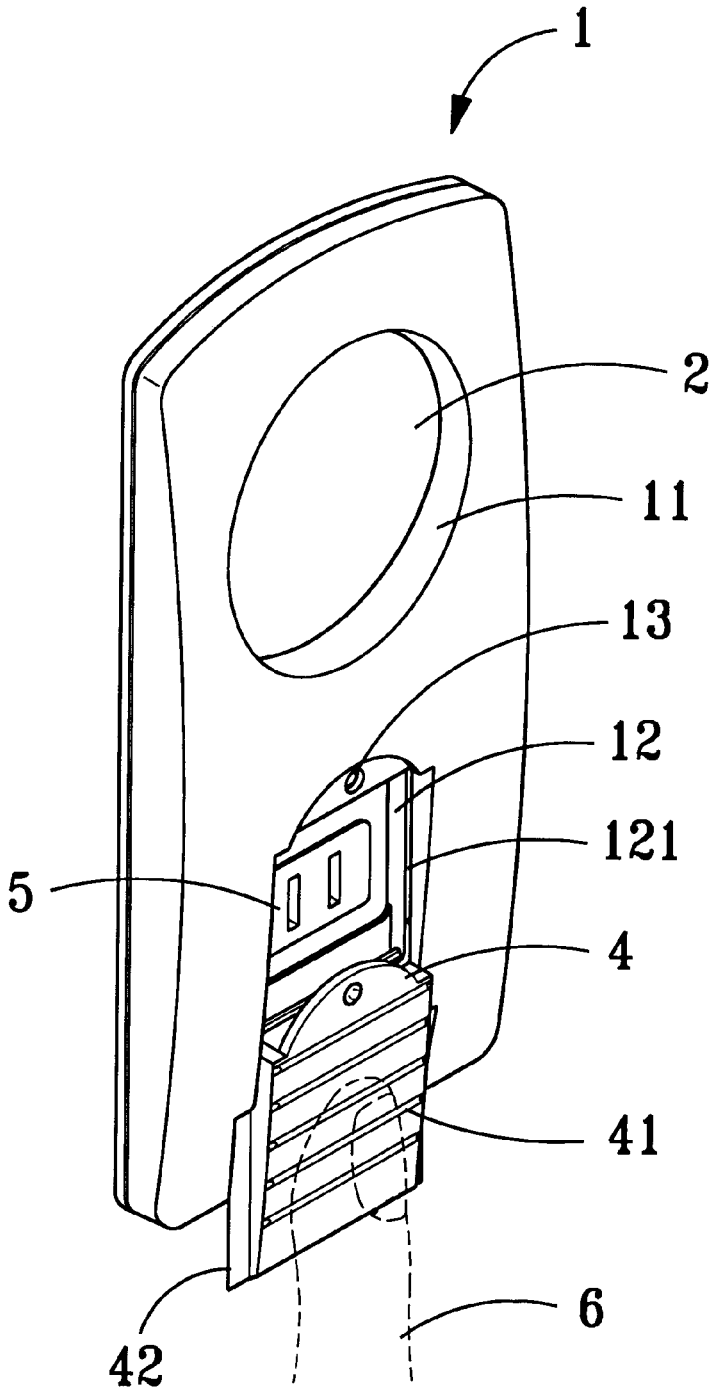
FIG. 3 is an operational schematic view showing structure of an electric luminescence night lamp of this invention.

As shown in FIG. 3 - an operational schematic view of this invention, when the plug 3 on back of the housing body 1 are inserted in a socket of a socket panel, the electric luminescence piece 2 will illuminate, and where the rectangular opening 12 in the housing body 1 is located exactly above a neighboring socket 5. In the case the lower socket 5 is not in use, the top cover 4 can be moved upwards by laying a finger 6 on the anti-slip strips 41 to push it till the protrusion dot 43 at top end of the top cover 4 is snapped and fastened to a recess 13 at top end of the rectangular opening 12, which is thereby thoroughly covered to prevent the socket 5 from being dusted or damped in order not to cause any unnecessary danger. When using of the socket 5 is desired, all a user has to do is push the top cover 4 downwards to enable the socket 5 to expose to air for use.

The improved structure of electric luminescence night lamp of this invention, in comparison with prior skills, is benefited with the following merits:

1. As a electric luminescence piece is used to serve for a light source, it is safer for radiation of negligible thermal energy to provide decent lightness.
2. The night lamp call be inserted in a socket flatly and intimately with a stable center of gravity without worry of loosening or dropping.
3. In virtue of the top cover that covers the neighboring socket when not in use to prevent it from being dusted or damped in order not to cause unexpected dangers.

In the above described, at least one preferred embodiment has been elucidated with reference to relating drawings annexed, it is apparent that numerous variations or modifications may be made without departing from the true spirit and scope thereof, as set forth in the following claims.

What is claimed is:

1. An electric luminescence night lamp comprising:

a housing body, said housing body includes a receptacle and a plug, a rectangular opening formed in a face of said housing body is provided with slide grooves at inner lateral edges of said rectangular opening, said rectangular opening is further provided with a recess at a top end of said rectangular opening;

an electric luminescence piece positioned in said receptacle, said electric luminescence piece serves as a light source of said night lamp;

a top cover to cover said rectangular opening, said top cover includes a protrusion, a plurality of antislip strips on an outer surface, and a pair of lateral slide tracks;

wherein said slide tracks of said top cover are received in said slide grooves such that said top cover is moved back and forth to open and close said rectangular opening, and when said top cover is closed, said protrusion of said top cover shall is received in said recess of said rectangular opening in order to secure said top cover.

* * * * *